United States Patent [19]

Schantz et al.

[11] 3,992,687

[45] Nov. 16, 1976

[54] BUZZ-PROOF SOLENOID

[75] Inventors: Spencer C. Schantz, New Berlin; Paul W. Wilberscheid, Sussex, both of Wis.

[73] Assignee: Spencer C. Schantz, New Berlin, Wis.

[22] Filed: June 20, 1975

[21] Appl. No.: 588,574

[52] U.S. Cl. ..... 335/247; 335/248; 335/262

[51] Int. Cl.[2] ..... H01F 7/12

[58] Field of Search ..... 335/247, 248, 249, 251, 335/257, 258, 262, 277

[56] References Cited

UNITED STATES PATENTS

| | | | |
|---|---|---|---|
| 2,651,744 | 9/1953 | Acklin et al. | 335/248 |
| 3,117,257 | 1/1964 | Stone | 335/262 X |
| 3,119,954 | 1/1964 | Bachi | 335/262 |
| 3,185,902 | 5/1965 | Fecho et al. | 335/247 X |
| 3,396,354 | 8/1968 | Fisher | 335/248 |
| 3,510,814 | 5/1970 | Nordfors | 335/262 |
| 3,593,240 | 7/1971 | Garczynski | 335/249 |

*Primary Examiner*—George Harris
*Attorney, Agent, or Firm*—Arthur L. Morsell, Jr.

[57] ABSTRACT

A slotted resilient wedging sleeve is slideably mounted on one end of a solenoid plunger in position to wedgingly coact with an inwardly chamfered edge on the adjacent axial end of the solenoid bobbin when the plunger is drawn into the bore of the bobbin by current flow through the coil. A compression spring on the end of the plunger urges the sleeve into wedging engagement with the chamfered edge and causes the inner periphery of the sleeve to take up any play between the bobbin and plunger, thereby eliminating buzzing of the plunger.

15 Claims, 12 Drawing Figures

BUZZ-PROOF SOLENOID

BACKGROUND OF THE INVENTION

This invention relates to solenoids operated by alternating electric current in which a ferromagnetic plunger is drawn into a bore by current flowing through a coil surrounding the bore. Clearance between the plunger and bore is provided to permit free movement of the plunger and absorb manufacturing tolerances. The inner axial end of the plunger usually contacts a ferromagnetic backstop in the bore when the plunger is fully drawn into the bore, the backstop being connected to a ferromagnetic frame which supports the bobbin and acts as a low reluctance path for the magnetic lines of force.

Shading coils have been used to provide a continuity of magnetic attraction as the alternating current in the coil passes through the zero point of its cycle by delaying the flux in the shaded portion of either the plunger or backstop where the shading ring is mounted.

Present designs of solenoids are vulnerable to buzzing when the alignment of the backstop and core face is not perfect. Elaborate machining and sizing operations are used in an attempt to provide the required alignment to prevent buzzing. These attempts have added to cost and have not eliminated the problem of buzzing caused by manufacturing tolerances or wear in use.

In one unsuccessful attempt to eliminate buzzing, the adjacent axial end surfaces of the plunger and backstop have been shaped as matching spherical surfaces to permit contact between the shading coil and the backstop even when the plunger is slightly tilted with respect to the bore. This arrangment is disclosed in U.S. Pat. No. 3,185,902 to R. G. Fecho et al. However, the use of spherical surfaces on the axially adjacent ends of the plunger and backstop also fails to eliminate buzzing.

SUMMARY OF THE INVENTION

In accordance with this invention, it has been found that a major component of buzzing in A.C. solenoids is due to transverse vibration of the other end of the plunger within the clearance between the plunger and the bore. This vibration has been eliminated in the solenoid of this invention by providing wedging means on the plunger positioned to interact with the coil supporting means at one end of the bore to take up any play between the bobbin and plunger and thus eliminate transverse vibration of the plunger.

DESCRIPTION OF THE ILLUSTRATED EMBODIMENTS

Figure 1:
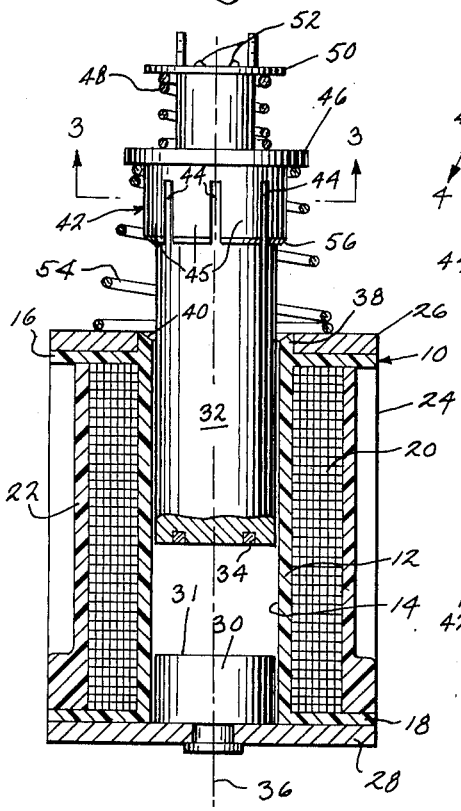
FIG. 1 is a longitudinal sectional view of one buzz-proof solenoid of this invention, the plunger being shown in its unactuated or outer position.
Figure 3:
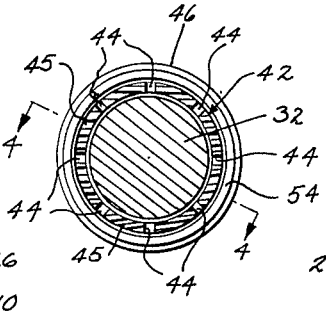
FIG. 3 is a cross-sectional view taken on the line 3—3 of FIG. 1.

FIG. 1 shows one buzz-proof A.C. solenoid of the invention. The A.C. solenoid includes a conventional non-magnetic bobbin 10 having a central cylindrical sleeve 12 whose inner surface forms a bore 14, and also having flanges 16 and 18 at the opposite axial ends of sleeve 14. A conventional electrical coil 20 is wound on sleeve 12 between flanges 16 and 18 and is covered on its outer surface by a layer of conventional encapsulating material 22. The ends of coil 20 are connected to conventional electrical terminals (not shown) through which coil 20 can be energized from a suitable source of alternating current.

Bobbin 10 and coil 20 are mounted on a C-shaped frame 24 made of ferromagnetic material and including an upper flange 26 and a lower flange 28 which are shown in cross-section in FIG. 1 and which are connected to a common back. A cylindrical backstop 30 made of ferromagnetic material is attached to lower flange 28 by conventional means and extends upwardly within the bottom of bore 14. Backstop 30 forms a stop for a ferromagnetic plunger 32 which is axially slideable within bore 14. Plunger 32 has a conventional shading coil 34 embedded within its inner axial end in a plane transverse to the plunger axis 36. A small clearance is provided between plunger 32 and bore 14 to permit plunger 32 to be freely axially movable within bore 14 without jamming.

Figure 2:
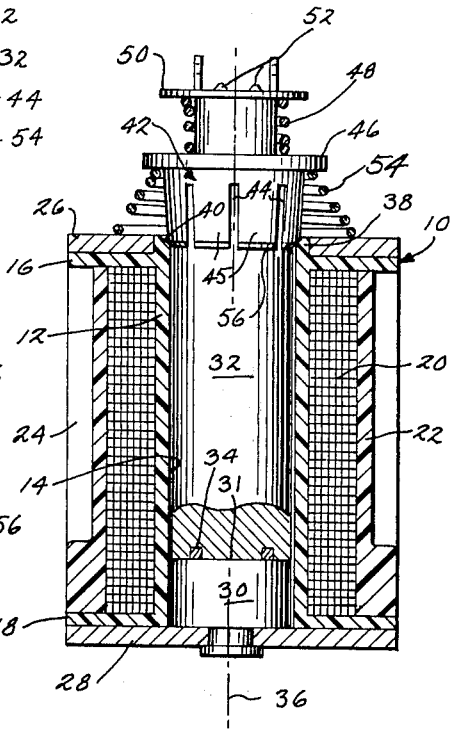
FIG. 2 is a longitudinal sectional view similar to FIG. 1 showing the plunger in its actuated or inner position.

When coil 20 is energized, the current flow produces a magnetic field which flows through plunger 32, backstop 30, and frame 24 and pulls plunger 32 toward backstop 30 until they contact as shown in FIG. 2. Frame 24, plunger 32, and backstop 30 form a low reluctance path for the magnetic lines of force to achieve maximum pull on plunger 32 for a given current in coil 20.

In accordance with this invention, buzzing of plunger 32 is eliminated by providing a novel wedging action between the plunger 32 and the means which supports coil 20, which in this embodiment is frame 24 and bobbin 10. In this particular embodiment, a collar 38 having an inwardly chamfered end edge 40 extends upwardly from the central sleeve 12 of bobbin 10 and extends through a matching opening in upper flange 26 of frame 24. A slotted flexible wedging sleeve 42 is slideably mounted on the top or outer end of plunger 32. Sleeve 42 has circumferentially spaced axially directed slots 44 extending upwardly from its lower or inner axial end and has an outwardly projecting flange 46 on its upper or outer axial end. Slots 44 form wedging fingers 45. A compression spring 48 bears on the upper surface of flange 46 and urges wedging sleeve 42 downward. The top end of compression spring 48 seats against the underside of a yoke 50 which is rigidly attached to the top or outer axial end of plunger 32 by stakes 52 on the top or outer axial end of plunger 32.

Figure 4:
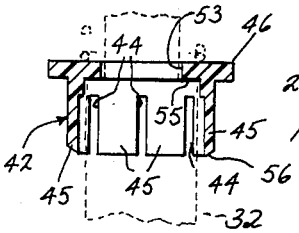
FIG. 4 is a fragmentary longitudinal sectional view taken on the line 4—4 of FIG. 3.

Wedging sleeve 42 has an inwardly directed flange 53 (FIG. 4) which seats on a shoulder 55 on plunger 32.

In this particular embodiment, wedging sleeve 42 and plunger 32 are both normally urged upwardly or axially outwardly by a conical return spring 54 whose top or outer end bears against the bottom of annular flange 46 and whose bottom or inner end seats on the top flange 24 of frame 24. Return spring 54 is not, however, an essential feature of the invention, since in some applications, plunger 32 may be normally urged upwardly or axially outwardly by the mechanism (not shown) to which yoke 50 is attached.

When coil 20 is energized, plunger 32 moves downwardly or axially inwardly into bore 14 until it contacts backstop 30 as shown in FIG. 2. This compresses both springs 48 and 54. Spring 48 is stronger than spring 54 and acts to move the inner axial end 56 of wedging sleeve 42 into snug wedging engagement with the chamfered edge 40 of bobbin 10 as shown in FIG. 2. During this action the lower ends of clamping fingers 45 exert a wedging action between the plunger and chamfer to take up any play. This eliminates transverse vibration of plunger 32 within bore 14 and thus eliminates buzzing. In this particular embodiment of the invention, the lower or inner axial end 56 of the wedging sleeve 42 is chamfered at the same angle as chamfer 40, but this is not essential since ends 56 of the fingers may have other shapes, i.e. they may be rounded or they may be squared, without preventing a wedging action imparted by chamfered bobbin edge 40 and compression spring 48. The essential action is to have a wedging action between the upper or outer axial end portion of plunger 32 and the means which supports coil 20 so as to eliminate vibration of plunger 32, thus eliminating buzzing. Any suitable wedging means which performs this function can be utilized.

When the current flow through coil 20 is switched off, return spring 54 moves plunger 32 and wedging sleeve 42 back to their unactuated or outer position shown in FIG. 1. In the return action, compression spring 48, which is at least partially compressed in the actuated or inner position shown in FIG. 2, contributes an upward or axially outward component of force which helps to overcome the residual magnetism that tends to hold plunger 32 and backstop 30 together.

Wedging sleeve 42 can be made of any material which is sufficiently flexible to perform a wedging action and which is sufficiently rigid to support the force applied thereto by compression spring 48. In one embodiment of the invention, wedging sleeve 42 was made of "Delrin" plastic and was fabricated by injection molding. The purpose of the slots 44 in sleeve 42 is to permit circumferential contraction of the bottom edge of sleeve 42 during the wedging action. The slots 44 may not be necessary in all cases since it is conceivable that a solid sleeve having sufficient flexibility could exert the wedging action if force were applied at spaced locations around the sleeve. However, slots 44 are preferable since fingers 45 are more easily acted on by the chamfer.

Figure 8A:
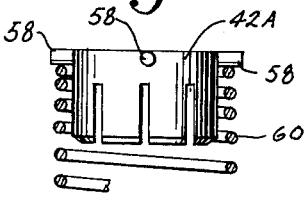
FIG. 8A is a side elevational view of a modification showing a wedging sleeve having outwardly projecting lugs engaging a cylindrical return spring.
Figure 8B:
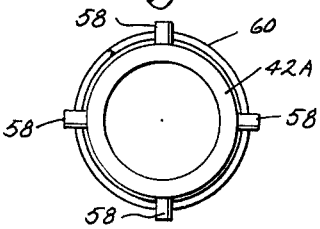
FIG. 8B is a plan view of the wedging sleeve of FIG. 8A.
Figure 9:
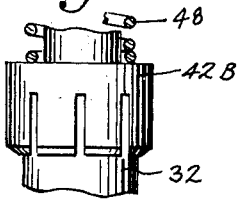
FIG. 9 is a side elevational view of a cylindrical wedging sleeve without a return spring or return spring flange.
Figure 10:
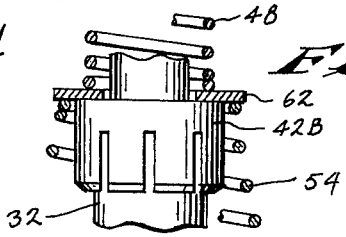
FIG. 10 is a side elevational view of a cylindrical wedging sleeve with a loose washer on top of the sleeve forming an annular seat for the return spring.

Several alternate forms for wedging sleeve 42 are shown in FIGS. 8, 9, and 10. FIGS. 8A and 8B show a sleeve 42A which is similar to sleeve 42 but which has peripherally spaced, outwardly projecting lugs 58 in place of flange 46. A cylindrical return spring 60 is shown with sleeve 42A in place of the conical spring 54. It should be noted that in both sleeves 42 and 42A the flange 46 and lugs 58 which are engaged by springs 54 and 60, respectively, are provided at no added cost when the sleeves are fabricated by injection molding.

FIG. 9 shows another modified sleeve 42B which is similar to sleeve 42 but lacks any abutment for a return spring. Sleeve 42B can be used in embodiments which do not require return springs, and also can be used in combination with a flat washer 62 (FIG. 10) in embodiments which do have return springs.

Figure 11:
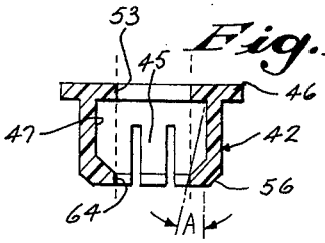
FIG. 11 is a longitudinal sectional view of the sleeve of FIGS. 3 and 4 showing an exaggerated reverse draft angle in the inner periphery of the sleeve.

In all of the sleeves 42, 42A, and 42B, the inner portion of the sleeve that is engageable with plunger 32 can be relieved by undercutting (A in FIG. 11) the inner diameter of the sleeve as shown in exaggerated form in FIG. 11 at 47. In the form of FIG. 11, the lower inside peripheral edge 64 of sleeve 42 closes the clearance between sleeve 42 and plunger 32, and the slots enhance the wedging action when the outside peripheral edge 56 of sleeve 42 coacts with the chamfered edge 40 of bobbin 10. If any appreciable clearnace exists between the inside peripheral edge 64 of sleeve 42 and plunger 32, part of the peripheral contraction of sleeve 42 will be lost in closing the clearance. Therefore, for maximum wedging effect, it is desirable to have the inside peripheral edge 64 of wedging sleeves 42, 42A, and 42B in contact with plunger 32. It is, of course, obvious that the arrangement of having the resilient fingers 45 on the plunger with the coating seat 40 on the bobbin may be reversed, i.e. the resilient fingers could be carried by the bobbin and a coacting part corresponding to the part 40 could be carried by the plunger.

Figure 5:
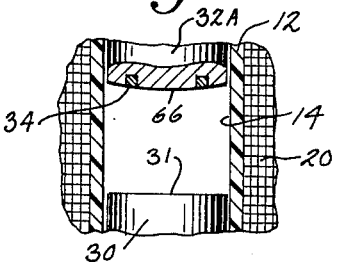
FIG. 5 is a fragmentary longitudinal sectional view showing a spherical surface on the inner axial end of the plunger in combination with a flat surface on the adjacent axial end of the backstop.
Figure 6:
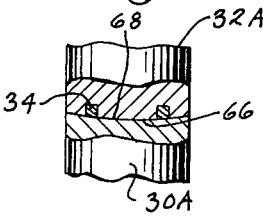
FIG. 6 is a fragmentary view similar to FIG. 5 showing spherical surfaces having equal radii on the inner axial end of the plunger and the adjacent axial end of the backstop.
Figure 7:
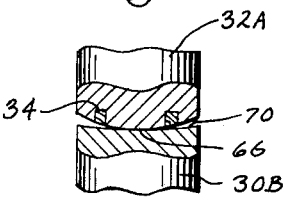
FIG. 7 is a fragmentary view similar to FIG. 5 showing spherical surfaces having unequal radii on the inner axial end of the plunger and the adjacent axial end of the backstop.

FIGS. 5, 6, and 7 show alternate contours for the adjacent axial ends of plunger 32 and backstop 30. In FIGS. 1 and 2, plunger 32 and backstop 30 both have flat surfaces on their adjacent axial ends. In FIG. 5, plunger 32A has a convex spherical surface 66 on its inner axial end, the radius of surface 66 being approximately equal to the distance between the inner axial end surface 31 of backstop 30 and the top of bobbin sleeve 14. The adjacent axial end surface 31 of backstop 30 is flat.

In FIG. 6, plunger 32A is shown in combination with a modified backstop 30A which has a concave or complementary spherical surface 68 on the axial end adjacent to convex surface 66, the radius of concave spherical surface 68 being equal to that of convex spherical surface 66.

In FIG. 7, convex spherical surface 66 is used in combination with a modified backstop 30B which has a concave spherical surface 70, the radius of concave surface 70 being slightly larger than the radius of convex spherical surface 66. It is obvious that the constructions illustrated in FIGS. 5, 6, and 7 can be reversed without departing from the spirit of the invention, i.e. the convexity shown at 66 in FIG. 5 can be on the backstop 30 with the lower end of the plunger 32A flat. Also referring to FIGS. 6 and 7, the convexity 66 may be on the backstop and the concavity on the lower end of the plunger. Any of the inner axial end surfaces shown in FIGS. 5, 6, and 7 can be used in combination with the solenoid and sleeves shown in FIGS. 1–4 and 8–11 to aid in preventing lateral movement of the plunger of a type which might produce buzzing.

Various changes and modifications may be made without departing from the spirit of the invention, and all of such changes are contemplated as may come within the scope of the claims.

What we claim is:

1. In a solenoid having a coil, having means supporting said coil, having a bore in said coil supporting means, and having a ferromagnetic plunger axially movable within said bore between an inner position and an outer position and having a portion projecting beyond one axial end of the bore, the improvement comprising a flexible wedging sleeve slideably mounted on a projecting portion of the plunger, a chamfered end on said coil supporting means adjacent to said axial end of said bore, said wedging sleeve being positioned to coact with said chamfered end in the inner position of said plunger to take up play between said plunger and said coil supporting means, said plunger having a portion projecting beyond the wedging sleeve and having a spring seat, and there being a first spring between said sleeve and said seat, there also being a second spring between the upper end of the coil supporting means and said sleeve serving as a return spring for the plunger, with the first spring being stiffer than the second spring.

2. In a solenoid having a coil, having means supporting said coil, having a bore in said coil supporting means, and having a ferromagnetic plunger axially movable within said bore between an inner position and an outer position and having a portion projecting beyond one axial end of the bore, the improvement comprising wedging means slideably mounted on said plunger, means normally urging said slideably mounted wedging means toward said coil supporting means, and cooperating wedging means on said coil supporting means at said axial end of the bore positioned to interact in the inner position of said plunger to effect a wedging action between the plunger and said coil supporting means to eliminate buzzing of the plunger when said core is energized.

3. In a solenoid having a coil, having means supporting said coil, having a bore in said coil supporting means, and having a ferromagnetic plunger axially movable within said bore between an inner position and an outer position and having a portion projecting beyond one axial end of the bore, the improvement comprising wedging means between said plunger and coil supporting means positioned to interact with said coil supporting means at said axial end of said bore in the inner position of said plunger to effect a wedging action between the plunger and said coil supporting means to eliminate buzzing of the plunger when said coil is energized, said plunger constituting one of a pair of cooperating members, and said coil supporting means constituting the other member of said pair, and said wedging means comprising a flexible wedging sleeve mounted on one of said cooperating members, with the other of said cooperating members having means positioned to coact with the wedging sleeve in the inner position of said plunger to take up play between the plunger and coil supporting means.

4. The solenoid of claim 3 in which the means which is positioned to coact with said wedging sleeve is a chamfer.

5. The solenoid of claim 3 in which the flexible wedging sleeve is mounted on a projecting portion of the plunger and in which there is a chamfered end on the coil supporting means adjacent to said axial end of said bore, with said wedging sleeve positioned to coact with said chamfered end in the inner position of said plunger to take up play between said plunger and said coil supporting means.

6. The solenoid of claim 3 wherein said wedging sleeve is longitudinally slotted to form circumferentially spaced wedging fingers.

7. The solenoid of claim 5 wherein said sleeve is slideably mounted on said plunger, and further comprising means on said plunger positioned to apply an axially inwardly directed force to said sleeve in the inner position of said plunger to cause wedging coaction between said sleeve and said chamfered edge.

8. The solenoid of claim 7 in which the means on said plunger which is positioned to apply an axially inwardly directed force to said sleeve is a compression spring.

9. The solenoid of claim 8 and also including a return spring coupled between said coil supporting means and said sleeve and operable to move said plunger from its inner to its outer position when said coil is de-energized, said return spring being weaker than said compression spring.

10. The solenoid of claim 5 wherein the axial end of said sleeve adjacent to said coil is also chamfered.

11. The solenoid of claim 5 wherein said sleeve is slideably mounted and wherein there is a spring seat on said sleeve, and spring means acting on said seat to urge said sleeve toward wedging engagement.

12. The solenoid of claim 5 wherein said sleeve is slideably mounted and further comprising cooperating stop means on said sleeve and plunger limiting inward movement of said sleeve.

13. The solenoid of claim 5 wherein the interior of said wedging sleeve has an undercut.

14. the solenoid of claim 2 wherein there is a ferromagnetic backstop within said bore forming one cooperating member positioned to contact said plunger in the inner position thereof, said plunger forming the other cooperating member, and wherein the end of said plunger has a convex spherical surface, the length of the radius of said spherical surface being approximately equal to the distance between the backstop and the top of the coil supporting means.

15. The solenoid of claim 14 in which the backstop has a concave spherical surface with a radius which is larger than the radius of the convex spherical surface which is on the end of the plunger.

* * * * *